US008622856B2

(12) United States Patent
Taniguchi et al.

(10) Patent No.: US 8,622,856 B2
(45) Date of Patent: Jan. 7, 2014

(54) THREE-DIMENSIONAL PANELS FOR A GAME BALL AND RELATED METHODS

(75) Inventors: Haruhusa Taniguchi, Hiroshima (JP); Hideomi Shishido, Hiroshima (JP); Shigeo Doi, Hiroshima (JP); Yoshihisa Okimura, Hiroshima (JP); Hans-Peter Nürnberg, Langenzenn (DE)

(73) Assignees: adidas International Marketing B.V., Amsterdam (NL); Molten Corporation, Hiroshima (JP)

( * ) Notice: Subject to any disclaimer, the term of this patent is extended or adjusted under 35 U.S.C. 154(b) by 0 days.

(21) Appl. No.: 12/944,257

(22) Filed: Nov. 11, 2010

(65) Prior Publication Data

US 2011/0111897 A1 May 12, 2011

Related U.S. Application Data

(63) Continuation of application No. 10/717,985, filed on Nov. 20, 2003, now Pat. No. 7,854,815.

(30) Foreign Application Priority Data

Nov. 26, 2002 (DE) ..... 102 55 092

(51) Int. Cl.
*A63B 41/08* (2006.01)

(52) U.S. Cl.
USPC ..... 473/604; 473/598; 473/607

(58) Field of Classification Search
USPC ..... 473/603–605, 598, 607, 609
See application file for complete search history.

(56) References Cited

U.S. PATENT DOCUMENTS

| | | | | |
|---|---|---|---|---|
| 1,187,029 | A | 6/1916 | Beebout | |
| 1,531,162 | A * | 3/1925 | Valero | 473/600 |
| 1,614,853 | A | 1/1927 | Schwartz | |
| 1,923,236 | A | 8/1933 | Sonnett | |
| 2,078,881 | A | 4/1937 | Munzinger | |
| 2,221,534 | A | 11/1940 | Voit et al. | |
| 2,874,964 | A | 2/1959 | Edwards | |
| 3,112,521 | A | 12/1963 | Ward | |

(Continued)

FOREIGN PATENT DOCUMENTS

| | | |
|---|---|---|
| DE | 2 125 758 A1 | 12/1972 |
| DE | 2 723 625 A1 | 12/1977 |

(Continued)

OTHER PUBLICATIONS

European Application No. 0894514, European Search Report mailed on Jan. 3, 2001.

(Continued)

*Primary Examiner* — Steven Wong
(74) *Attorney, Agent, or Firm* — Kilpatrick Townsend & Stockton LLP

(57) ABSTRACT

A method of manufacturing a multi-layer outer panel for a game ball includes three-dimensionally forming a top layer of an outer panel, as well as one or more backing materials disposed underneath the top layer, into a shape substantially corresponding to the surface of the ball. Multi-layer outer panels are then attached to or interconnected to surround an inflatable bladder, thereby producing a game ball while minimizing overstretching of the outer material or the backing material and improving resistance of the outer panels to delamination.

27 Claims, 9 Drawing Sheets

(56) References Cited

U.S. PATENT DOCUMENTS

| | | | | |
|---|---|---|---|---|
| 3,119,618 | A | 1/1964 | Molitor et al. | |
| 3,185,476 | A | 5/1965 | Fechner | |
| 3,512,777 | A * | 5/1970 | Henderson | 473/597 |
| 4,065,150 | A | 12/1977 | Van Auken | |
| 4,154,789 | A | 5/1979 | Delacoste | |
| 4,157,424 | A | 6/1979 | Boutle | |
| 4,285,846 | A | 8/1981 | Hardy et al. | |
| 4,333,648 | A | 6/1982 | Aoyama | |
| 4,399,992 | A | 8/1983 | Molitor | |
| 4,462,590 | A | 7/1984 | Mitchell | |
| 4,660,831 | A | 4/1987 | Kralik | |
| 4,798,386 | A | 1/1989 | Berard | |
| 4,802,671 | A | 2/1989 | Gentiluomo | |
| 4,856,781 | A | 8/1989 | Shishido et al. | |
| 4,998,734 | A | 3/1991 | Meyer | |
| 5,040,795 | A | 8/1991 | Sonntag | |
| 5,091,265 | A | 2/1992 | Kennedy et al. | |
| 5,104,126 | A | 4/1992 | Gentiluomo | |
| 5,123,659 | A | 6/1992 | Williams | |
| 5,181,717 | A | 1/1993 | Donntag et al. | |
| 5,310,178 | A | 5/1994 | Walker et al. | |
| 5,320,345 | A * | 6/1994 | Lai et al. | 473/601 |
| 5,405,469 | A | 4/1995 | Lin | |
| 5,413,331 | A | 5/1995 | Stillinger | |
| 5,516,107 | A | 5/1996 | Okumoto et al. | |
| 5,624,517 | A | 4/1997 | Giesen et al. | |
| 5,649,701 | A * | 7/1997 | Mills et al. | 473/604 |
| 5,672,120 | A | 9/1997 | Ramirez et al. | |
| 5,688,192 | A | 11/1997 | Aoyama | |
| 5,688,198 | A | 11/1997 | Teifert et al. | |
| 5,741,195 | A | 4/1998 | Sullivan et al. | |
| 5,752,890 | A | 5/1998 | Shishido et al. | |
| 5,759,123 | A | 6/1998 | Ou | |
| 5,766,707 | A | 6/1998 | Obermaier | |
| 5,772,545 | A | 6/1998 | Ou | |
| 5,823,889 | A | 10/1998 | Aoyama | |
| 5,865,697 | A | 2/1999 | Molitor et al. | |
| 5,888,157 | A | 3/1999 | Guenther et al. | |
| 6,099,423 | A | 8/2000 | Ou | |
| 6,206,795 | B1 * | 3/2001 | Ou | 473/599 |
| 6,245,862 | B1 | 6/2001 | Rajagopalan | |
| 6,302,815 | B1 * | 10/2001 | Shishido et al. | 473/604 |
| 6,306,054 | B1 | 10/2001 | Dobrounig | |
| 6,458,229 | B2 | 10/2002 | Dobrounig | |
| 6,500,082 | B1 * | 12/2002 | Ou | 473/599 |
| 6,503,162 | B1 * | 1/2003 | Shishido et al. | 473/605 |
| 6,656,067 | B2 * | 12/2003 | Ou | 473/605 |
| 6,685,585 | B2 * | 2/2004 | Shishido et al. | 473/605 |
| 6,726,582 | B1 * | 4/2004 | Kuo et al. | 473/604 |
| 6,726,583 | B1 * | 4/2004 | Lai | 473/605 |
| 7,854,815 | B2 * | 12/2010 | Taniguchi et al. | 156/146 |
| 2002/0091024 | A1 * | 7/2002 | Ou | 473/604 |
| 2003/0078119 | A1 * | 4/2003 | Shishido et al. | 473/605 |
| 2004/0077443 | A1 * | 4/2004 | Chen | 473/604 |
| 2004/0087396 | A1 * | 5/2004 | Chan | 473/605 |
| 2007/0129188 | A1 * | 6/2007 | Maziarz et al. | 473/603 |
| 2008/0188334 | A1 * | 8/2008 | Feeney et al. | 473/605 |
| 2009/0011878 | A1 * | 1/2009 | Ou | 473/605 |
| 2009/0209374 | A1 * | 8/2009 | Ou | 473/605 |

FOREIGN PATENT DOCUMENTS

| | | | |
|---|---|---|---|
| EP | 0 894 514 | A2 | 2/1999 |
| EP | 1 080 745 | A1 | 3/2001 |
| FR | 2 215 249 | A1 | 8/1974 |
| FR | 2 443 850 | A1 | 7/1980 |
| FR | 7 835 342 | | 7/1980 |
| FR | 2 572 674 | A1 | 5/1986 |
| GB | 1095969 | | 12/1967 |
| JP | 27-3908 | | 5/1952 |
| JP | 38-16729 | | 8/1963 |
| JP | 54-065638 | A | 5/1979 |
| JP | 58-215335 | A | 12/1983 |
| JP | 1983-215335 | | 12/1983 |
| JP | 01-265979 | | 10/1989 |
| JP | 8-252341 | A | 10/1996 |
| JP | 09-019516 | | 1/1997 |
| JP | 10-323409 | A | 12/1998 |
| WO | WO 95/09034 | A1 | 4/1995 |
| WO | WO 97/17109 | A1 | 5/1997 |
| WO | WO 99/15242 | A1 | 4/1999 |

OTHER PUBLICATIONS

German Application No. 98110837.6-2315, European Search Report mailed on Nov. 9, 1999.

* cited by examiner

THREE-DIMENSIONAL PANELS FOR A GAME BALL AND RELATED METHODS

CROSS-REFERENCE TO RELATED APPLICATION

This is a continuation of application Ser. No. 10/717,985, filed Nov. 20, 2003, now U.S. Pat. No. 7,854,815, the disclosure of which is hereby incorporated by reference herein in its entirety. This application claims priority to and the benefit of German Patent Application Serial No. 102555092.1, filed Nov. 26, 2002, the entire disclosure of which is hereby incorporated herein by reference.

TECHNICAL FIELD

The present invention relates to a ball for a ball game, such as a soccer ball. More specifically, the invention relates to a game ball having a plurality of three-dimensional panels forming an outer layer of the ball and methods of manufacturing such panels.

BACKGROUND OF THE INVENTION

There are many different methods for producing game balls. For example, balls for children are typically manufactured from plastic materials such as polyvinyl chloride. During manufacture, a liquid material is poured into a mold, where it solidifies to form a finished ball or at least one layer of the ball's outer cover. A typical method is disclosed in German Patent No. DE 27 23 625, which is hereby incorporated by reference herein in its entirety.

Higher quality balls, such as, for example, soccer balls for tournament play, typically have an outer layer assembled from separate panels that surround an inflatable bladder. Conventionally, there have been two kinds of game balls, a laminated ball and a hand-stitched ball. As disclosed in U.S. Pat. Nos. 4,333,648 and 6,503,162, the disclosures of which are hereby incorporated by reference herein in their entireties, an exemplary laminated ball includes a bladder made from air impermeable rubber. The bladder has a spherical hollow body into which compressed air is pumped through a valve. The ball further includes a reinforced layer formed by circumferentially winding a fiber, for example, a nylon filament, onto the entire surface of the bladder in order to reinforce the bladder and enhance mechanical properties of the ball, such as, for example, uniformity of size and weight distribution, sphericity, durability, and shape retention. A cover layer made of thin vulcanized rubber is then bonded onto the reinforcing layer, and an outer layer including a plurality of panels is mounted onto the cover layer. The cover layer typically serves to improve a bond between the panels and the ball's core. The panels are typically manufactured from artificial or natural leather. An end of the back of the leather panel is usually cut obliquely and a trench, having a substantially V-shape, is formed at a panel joint so that the panel wraps relatively smoothly around the ball.

A hand-stitched ball has a structure in which the bladder described above is surrounded by and is housed in an outer layer having a spherical shape formed by folding edges of a plurality of panels (also typically made from artificial or natural leather) toward the inside and sewing them together with a thread (usually about 10,000 deniers). Conventionally, a backing member formed by a plurality of woven fabrics is attached to the inside of the panel. For example, the woven fabrics can be bonded onto the inside of the panel with an adhesive such as a latex paste, thereby reinforcing the panel and providing additional cushioning during play. The panels described above, for example, pentagons and hexagons of a soccer ball, are typically produced as flat two-dimensional panels (not taking into account the thickness of the material).

FIGS. 1A-1C schematically illustrate the manufacture of such two-dimensional panels according to methods known in the art. Referring to FIGS. 1A-1B, layers 2, 3 are laminated to form a source material 5 of desired thickness. Two-dimensional panels 7 of desired size and shape are then cut out from the laminate 5 and, as shown in FIG. 1C, are sewn together or laminated onto a rubber bladder 9. As mentioned above, however, hand-sewing, as well as laminating, are complicated processing techniques that are difficult to automate. The more stitches or panel edges the ball has, the more costly it is to produce the ball.

Furthermore, the edges of the panels may cause delamination between the ball's component layers. Also, hand-stitched seams may be damaged after prolonged use. In particular, moisture may seep into the stitched seams, thereby disrupting the weight distribution of the ball so that it reacts unpredictably during play. Finally, the elastic properties of such assembled balls are not completely homogenous. For example, a soccer ball may react differently when it is kicked in the center of a panel as compared to when the player's foot contacts the seam between two panels.

In an attempt to minimize the disadvantages mentioned above, it has been known to decrease the number and increase the size of the panels, thereby reducing the number of stitched seams or border regions. A lower number of panels, however, leads to a structure, where each individual panel covers a larger section of the surface of the ball. Because the panels are two-dimensional, each panel needs to be curved to adapt to the rounded surface of the ball. Such shaping, however, may cause a considerable internal stress and strain on the panel. The larger the panel the greater the stress resulting from its curvature. Such stress may cause undesirable shape deviations and inhomogeneous elastic properties when the ball is inflated. To address these shortcomings, it has been proposed in, for example, French Patent Publication No. FR 2 443 850 and Japanese Unexamined Patent Publication No. JP 58-215335, the disclosures of which are hereby incorporated by reference herein in their entireties, to preform the panels prior to mounting them onto the bladder, to reduce the stress of the stitched seams or the border regions.

Known approaches, however, do not take into account the multi-layer composition of modern high performance balls, wherein one or more layers are arranged underneath the outer layer. During play, these additional layers are also subjected to considerable mechanical loads. Exemplary multi-layer systems for game balls are disclosed in European Patent Publication No. EP 0 894 514 and U.S. Pat. No. 6,306,054, the disclosures of which are hereby incorporated by reference herein in their entireties. Due to the high pressure inside the ball and load fluctuation during play, one or more interior layers may delaminate from the outer material, thereby compromising the ball's performance.

There is, therefore, a need for a game ball having larger outer panels with improved resistance to delamination of component layers and homogeneity of elastic properties.

SUMMARY OF THE INVENTION

Thus, it is an object of the present invention to provide improved methods of manufacturing multi-layer outer panels for a game ball and a game ball that address the disadvantages of known methods.

In accordance with the invention, a top layer of an outer panel, as well as one or more backing materials disposed underneath the top layer, are preformed into a shape corresponding to a surface of the ball. Multi-layer outer panels are then attached to or interconnected to surround a bladder, thereby producing a game ball while minimizing overstretching of the outer material or the backing material and improving resistance of the outer panels to delamination. Further, because the overstretching is reduced, a game ball having outer panels produced according to the invention has more homogeneous elastic properties as compared to known game balls. Further yet, the method according to the invention promotes the manufacture of game balls having larger outer panels, which, because of the smaller number of seams or border regions, improves environmental stability, durability, and shape retention, further improves homogeneity of the elastic properties and decreases manufacturing costs. Finally, larger outer panels lead to a greater freedom for creating ornamental designs on the surface of the game balls, because of the smaller number of interrupting seams or border regions.

In general, in one aspect, the invention relates to a method of manufacturing a multi-layer outer panel for a game ball. The method includes three-dimensionally forming a top layer that includes a first material and has an outer surface and an inner surface (step (a)). The outer surface of the top layer is dimensioned to substantially correspond to a section of a surface of the ball. The method further includes three-dimensionally forming at least one backing layer that includes a second material and has an outer surface and an inner surface (step (b)). The inner surface of the at least one backing layer is dimensioned to substantially correspond to the section of the surface of the ball. The method also includes connecting the inner surface of the top layer and the outer surface of the at least one backing layer, thereby forming the outer panel (step (c)). In various embodiments, the outer surface of the at least one backing layer is dimensioned to substantially match the inner surface of the top layer. Also, the outer panel may have a predetermined radius of curvature substantially matching a radius of the game ball.

In one embodiment, step (b) is performed prior to step (a). In this embodiment, the at least one backing layer is used to three-dimensionally form the top layer by, for example, at least one of deep drawing, vacuum forming, injection molding, or dipping the backing layer into the first material. Alternatively, the top layer can be formed by spraying the first material onto the backing layer. In a particular version of this embodiment, the backing layer is used on a lower side of a stamp for deep drawing the top layer.

In another embodiment, the top layer is three-dimensionally formed by at least one of deep drawing, vacuum forming, injection molding, and spraying into a mold. In this embodiment, step (a) may be performed prior to step (b) and the top layer may be used to three-dimensionally form the backing layer, for example, the top layer can be at least partially used as a mold for three-dimensionally forming the backing layer. In yet another embodiment, step (a) and step (b) are performed independently. The top layer and the at least one backing layer may be connected by at least one of a chemical bond, a physical bond, and an adhesive. In one embodiment, the outer panel is substantially free of mechanical stress at an interface between the top layer and the at least one backing layer.

In various embodiments of the invention, the first material includes a thermoplastic elastomer, for example, polyurethane, polyester, polyamide, polyolefin, polyethylene, polyvinyl chloride, or polybutadiene. In a particular embodiment, the first material is substantially transparent, and, prior to step (a), at least one image may be provided on at least one surface of the first material. In this version, the method includes cutting the first material into a two-dimensional section. The step of providing an image on at least one surface of the first material may include depositing an imaging material onto the at least one surface of the first material.

The second material may include a foam material, for example, polyurethane, ethylene vinyl acetate, or latex. The foam material can be prevulcanized prior to the three-dimensional forming of the backing layer. A substrate layer including, for example, a textile material can be attached to the inner surface of the at least one backing layer. The second material may include a mesh material.

In general, in another aspect, the invention features a method for manufacturing a game ball. The method includes providing a plurality of panels and an air-impermeable bladder having a substantially spherical shape. Each panel, according to this aspect of the invention, includes a three-dimensional top layer that includes a first material and has an outer surface and an inner surface and at least one three-dimensional backing layer that includes a second material and has an outer surface and an inner surface. The outer surface of the top layer is dimensioned to substantially correspond to a section of a surface of the ball. The outer surface of the three-dimensional backing layer is connected to the inner surface of the top layer. The method also includes interconnecting the edges of the panels, thereby forming an outer layer of the ball surrounding the bladder.

In one embodiment of this aspect of the invention, the method further includes adhesively mounting the plurality of panels onto the bladder. A reinforcing layer, for example, including a flexible, substantially spherical skeletal frame separate from and surrounding the bladder, is optionally interposed between the plurality of panels and the bladder. In another embodiment of the invention, the outer layer forms a self-supporting structure.

In yet another embodiment, the air-impermeable bladder includes an elastic material. In this embodiment, the game ball is inflatable, and, in the inflated state, the radius of the game ball exceeds a predetermined radius of curvature of each of the plurality of panels.

Also, the invention features multi-layer outer panels and a game ball manufactured in accordance with the methods described above.

The advantages and features of the present invention herein disclosed will become apparent through reference to the following description, the accompanying drawings, and the claims. Furthermore, it is to be understood that the features of the various embodiments described herein are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DETAILED DESCRIPTION

In the following description, various embodiments of the methods according to the invention for the manufacture of three-dimensional panels for a game ball are discussed in detail using the manufacture of hexagons or pentagons for a soccer ball as an example. However, it is to be understood that outer panels for other game balls, such as handballs, volleyballs, rugby balls, etc., can also be manufactured using the methods disclosed herein. Also, three-dimensional outer panels can be manufactured in a wide variety of shapes including, for example, diamonds, Z-shapes, or V-shapes.

Figure 1A:
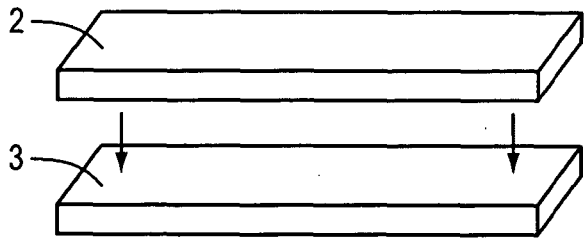
FIG. 1A PRIOR ART
FIGS. 1A-1C depict a schematic representation of a method of manufacturing two-dimensional panels according to methods known in the art.
Figure 1B:
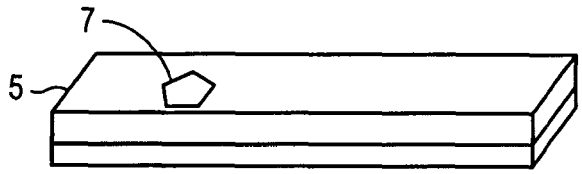
FIG. 1B PRIOR ART
Figure 1C:
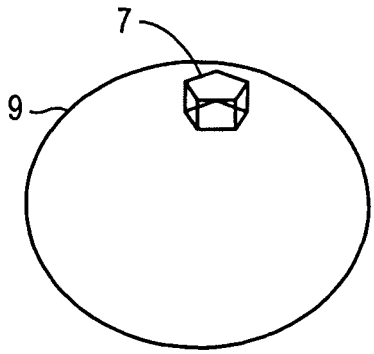
FIG. 1C PRIOR ART
Figure 2:
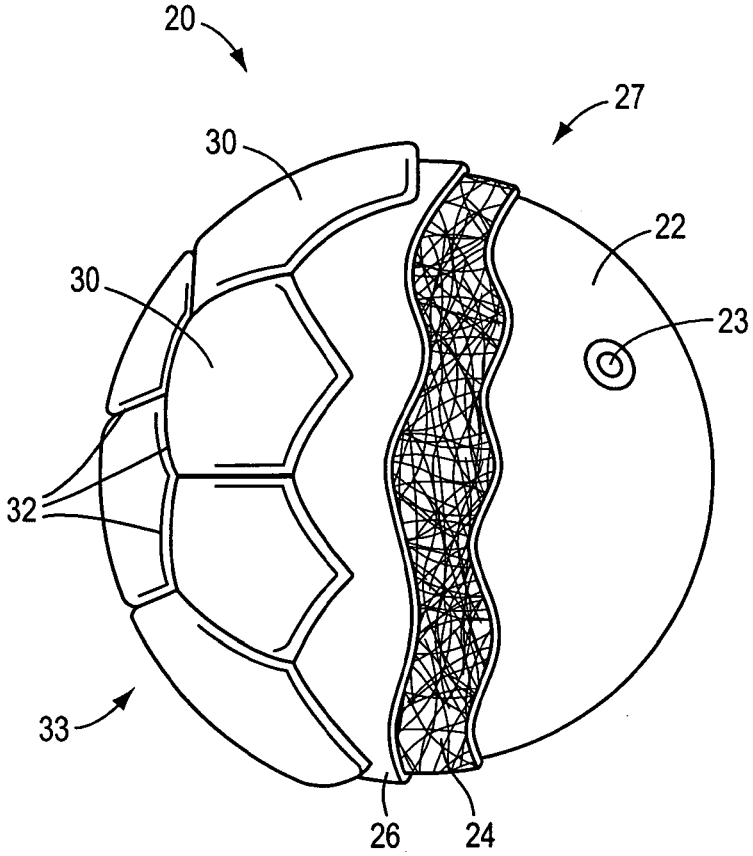
FIG. 2 depicts a partially cut-away perspective view showing a game ball having three-dimensional multi-layer outer panels manufactured in accordance with one embodiment of the invention.

Referring to FIG. 2, in one embodiment, a game ball 20 includes an air-impermeable bladder 22 having a substantially spherical hollow body into which compressed air is pumped through a valve 23. In a particular embodiment, the bladder 22 is formed from an elastic material, for example, rubber or latex. The ball may optionally include a reinforcing layer 24 formed by circumferentially winding a fiber, for example, a nylon filament, onto the entire surface of the bladder 22 in order to enhance the mechanical properties of the ball 20, such as, for example, uniformity of size and weight distribution, sphericity, durability, and shape retention. Also optionally, a thin cover layer 26 made of, for example, vulcanized rubber may then be bonded onto the reinforcing layer 24. The bladder 22 and the reinforcing layer 24 with or without the cover layer 26 form a carcass 27.

A plurality of three-dimensional outer panels 30 manufactured according to the methods of the invention discussed in greater detail below, are mounted onto the bladder 22 or the carcass 27. In some embodiments, the panels 30 are directly attached to the uppermost layer, i.e. the bladder 22, the reinforcing layer 24, or the cover layer 26. In other embodiments, the edges 32 of the panels 30 are interconnected, thereby forming an outer layer 33 surrounding the bladder 22 or the carcass 27. The outer layer 33 may or may not form a self-supporting structure.

Figure 3:
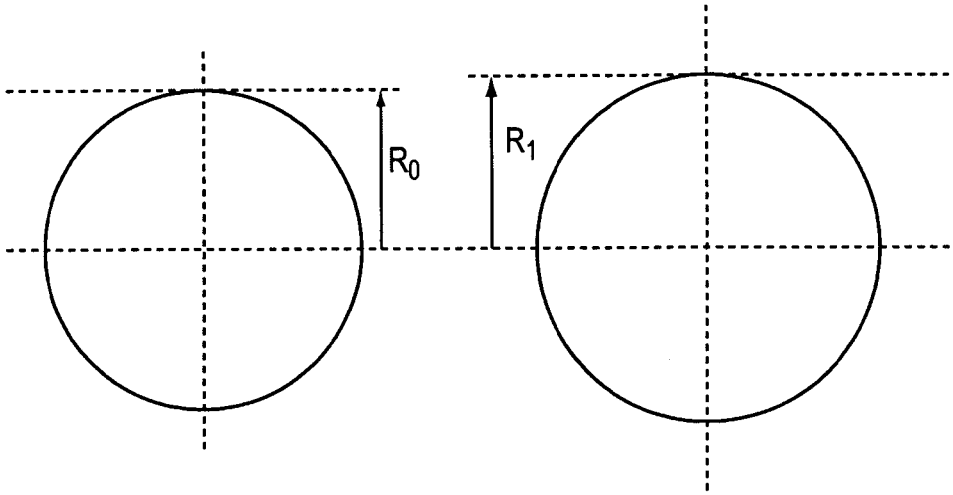
FIG. 3 depicts a schematic representation of the different radii of a game ball after interconnecting the panels to form an outer layer and after inflating the ball.

Referring to FIG. 3, after the panels are attached, a game ball is obtained having a radius $R_o$. This radius should preferably be slightly smaller than a radius $R_1$ of the inflated ball. When the ball is inflated and expands, the panels 30 become evenly stretched, which further improves resiliency of the ball. The ratio of the radius of the uninflated ball to the inflated ball typically ranges from about 95.5% to 99.5%. In one embodiment, $R_o$ equals 109 mm, $R_1$ equals 110 mm (per FIFA regulations), and, therefore, the ratio is about 99.1%.

Figure 4:
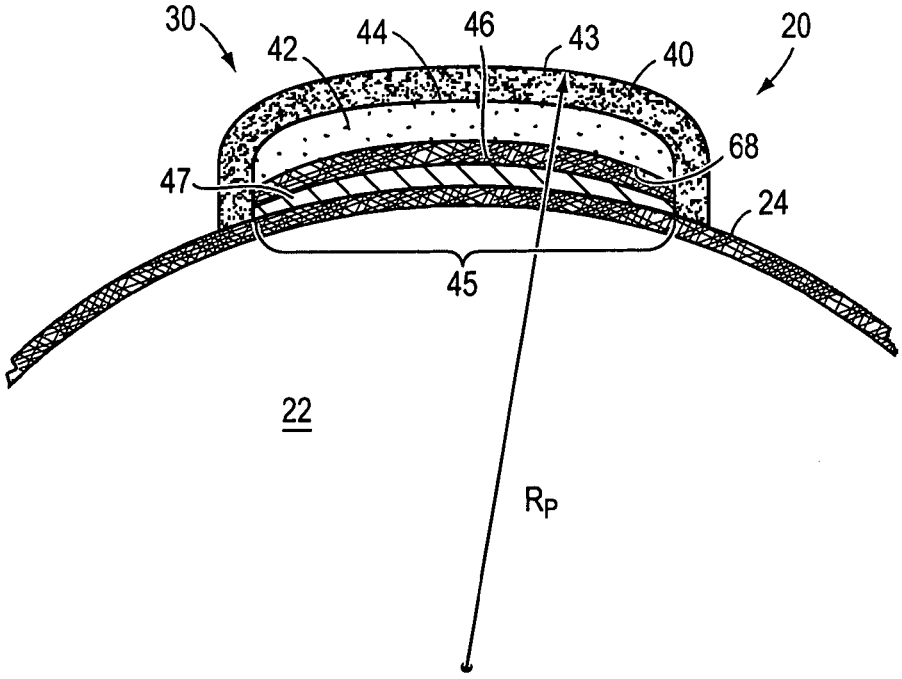
FIG. 4 depicts a schematic cross-sectional view of a three-dimensional multi-layer outer panel according to one embodiment of the invention.

Referring to FIG. 4, each panel 30 includes a top layer 40 and at least one backing layer 42 disposed underneath the top layer 40 to improve elastic properties and overall performance of the game ball. The outer surface 43 of the top layer 40 and the inner surface 68 of the backing layer 42 are dimensioned to substantially correspond to a section of a surface 45 of the bladder 22 or the carcass 27. Thus, for example, the outer panel 30 may have a predetermined radius of curvature $R_p$ substantially matching the radius $R_o$ (FIG. 3) of the uninflated ball 20, when the outer panel 30 is in a substantially unloaded state.

Optionally, a mesh material 46 can be used as a substrate for the backing layer 42 or can be embedded into the backing layer 42 for structural durability. The mesh material 46 may be formed from a natural fiber, such as cotton or a synthetic material such as, for example, polyester yarn, nylon, or any combination thereof. The backing layer 42 may have additional layers interposed between it and the bladder 22 or the carcass 27, for example, an additional substrate layer 47 to increase the mechanical stability of the panel 30, including, for example, a textile material.

Figure 5A:
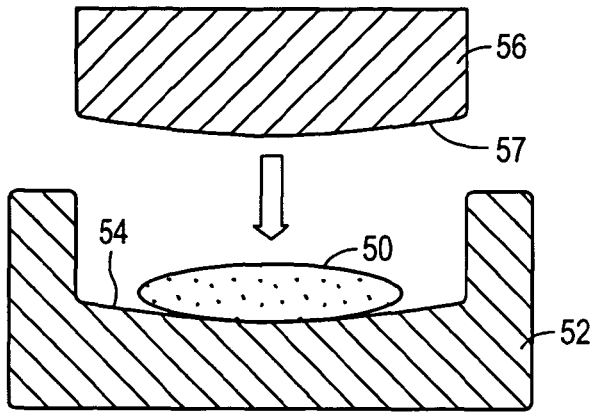
FIGS. 5A-5F depict a schematic representation of the steps of the method of manufacturing a multi-layer outer panel according to one embodiment of the present invention.

In one embodiment of the invention, the panel 30 is manufactured by first producing the backing layer 42 and then using the backing layer 42 to shape the top layer 40. Referring to FIG. 5A, a method of manufacturing a multi-layer outer panel includes inserting a predetermined amount of a foam material 50 into a mold 52. The foam material 50 can be a portion of a bulk material of a predetermined size. In another embodiment, the foam material is directly extruded into the mold 52. The inner surface 54 of the mold 52 is convex and substantially corresponds to a section of the surface 45 of the bladder 22 or the carcass 27.

In some embodiments, the foam material 50 is a prevulcanized preform, i.e., a material having cross-linking agents contained therein not completely vulcanized. The preform can be pre-vulcanized for adjustment of the mechanical properties and for the provision of the initial shape thereof. The pre-vulcanization step is typically carried out at temperatures from about 155° C. to about 170° C. Compared to conventional vulcanization, pre-vulcanization requires a shortened period of processing time. Suitable foam materials include, but are not limited to, polyurethane foam, ethylene vinyl acetate foam, and latex foam.

Figure 5B:
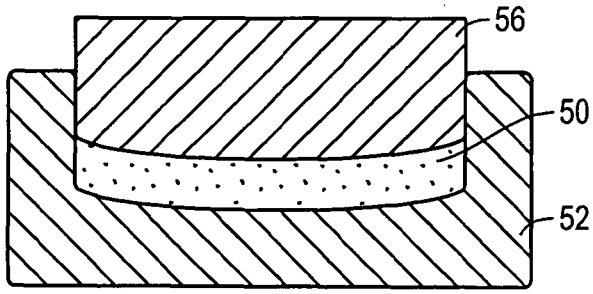

Referring to FIG. 5B, in one embodiment, the foam material 50 is heated to a temperature ranging from about 90° C. to about 120° C. and then three-dimensionally formed in the mold 52 using a stamp 56. The outer surface 57 of the stamp 56 is concave and substantially corresponds to a section of the surface 45 of the bladder 22 or the carcass 27.

Figure 5C:
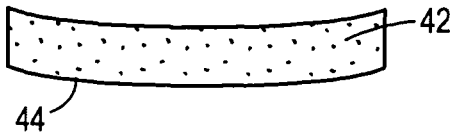

The process temperature generally depends upon which foam material 50 is used. In one embodiment, the mold 52 is kept at a room temperature. In another embodiment, the mold 52 is kept at a temperature ranging from about 30° C. to about 120° C. The foam material 50 expands and vulcanizes under pressure in the cavity defined by the mold 52 and the stamp 56 when the stamp 56 is lowered into the mold 52. After the stamp 56 is withdrawn, the material 50 assumes the three-dimensional shape forming the backing layer 42, as shown in FIG. 5C. Methods of three-dimensional forming of the backing layer 42, include, but are not limited to, deep drawing, vacuum forming, and injection molding.

Figure 5D:
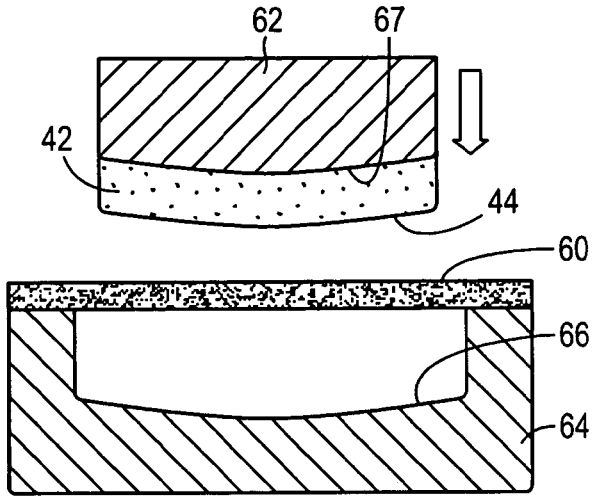
Figure 5E:
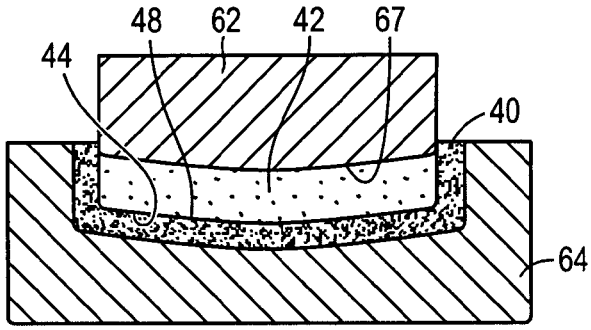
Figure 5F:
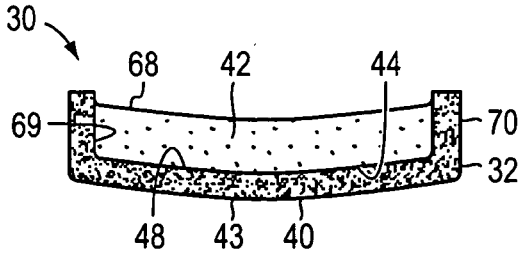

Referring to FIGS. 5D-5F, after producing the backing layer 42, the top layer 40 is three-dimensionally formed using the backing layer 42, such that the outer surface 44 of the backing layer 42 matches the inner surface 48 of the top layer 40. In one embodiment, thermoplastic elastomers, such as, for example, polyurethane, polyester, polyamide, polyolefin, polyethylene, polyvinyl chloride, and polybutadiene, are suitable starting materials for the top layer 40. In a particular embodiment, the top layer 40 includes a transparent thermoplastic urethane. A transparent top layer enables imprinting patterns, text, or graphics on at least the inner side of the top layer 40. Alternative methods of applying patterns, text, or graphics to the top layer 40 could be employed. As a result, these ornamentations are visible to the user, while effectively protected against abrasion of the top layer 40.

Referring now to FIG. 5D, prior to three-dimensional forming, the top layer material is cut into substantially two-dimensional sheets 60, which are then heated, using, for example, infrared radiation or hot air. In one embodiment, the sheet 60 is then deep drawn by means of a moveable stamp 62 receivable in a mold 64. The inner surface 66 of the mold 64 is convex and substantially corresponds to a section of the surface 45 of the bladder 22 or the carcass 27. The backing layer 42 is disposed on the side 67 of the stamp 62 that contacts the sheet 60.

Referring to FIG. 5E, the sheet 60 is three-dimensionally formed into the top layer 40 by deep drawing using the stamp 62 having the backing layer 42 disposed thereon. Because the outer surface 44 of the backing layer 42 is used to shape the inner surface 48 of the top layer 40, the curvature of the outer surface 44 of the backing layer 42 substantially matches the curvature of the inner surface 48 of the top layer 40, and both of these surfaces substantially correspond to the section of the surface 45 of the bladder 22 or the carcass 27.

Referring to FIG. 5F, the outer surface 44 of the backing layer 42 may be connected to the inner surface 48 of the top layer 40 either during the three-dimensional forming of the top layer 40, or in a separate step after the top layer 40 is formed. Suitable methods to connect the backing layer 42 and the top layer 40 to form the outer panel 30 include, but are not limited to, chemical bonding and physical bonding, such as, for example, using an adhesive or welding, or a combination of chemical and physical bonding. The resulting bond between the top layer 40 and the backing layer 42 is substantially free of mechanical stress at the interface therebetween, because of the matching contacting surfaces of the layers. The impact strength and delamination resistance of the outer panel 30 is thereby improved. In some embodiments of the invention, after the backing layer 42 is connected to the top layer 40, the resulting panel 30 can be chemically post-treated to obtain specific elastic properties, or painted.

Still referring to FIG. 5F, in various embodiments, the outer surface 43 of the top layer 40 is slightly larger than the inner surface 68 of the backing layer 42 so that the backing layer 42 is partially enclosed by the top layer 40 over the outer surface 44 and along the sidewall 69. Thus, the panel 30 is formed with rounded edges 32 having a sidewall 70. This arrangement of the top layer 40 and the backing layer 42 facilitates the interconnection of the panels 30 to form the outer layer 33 by, for example, stitching or laminating along the sidewalls 70 of the rounded edges 32. Also, the sidewalls 70 of the edges 32 afford improved resistance to undesirable moisture penetration through the outer layer 33. Moisture resistance can be further improved by sealing the joints between the adjacent panels 30 with a silicon gel or other sealant known in the art.

Figure 6A:
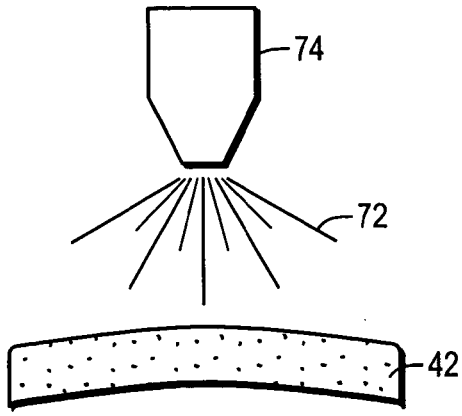
FIGS. 6A-6B depict a schematic representation of the steps of methods of manufacturing a multi-layer outer panel according to two alternative embodiments of the present invention.
Figure 6B:
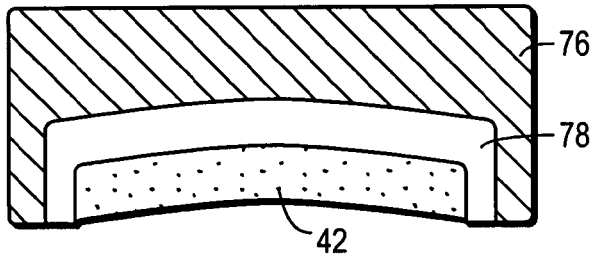

Other methods of three-dimensional forming of the top layer 40 using the backing layer 42 can also be employed. Referring to FIG. 6A, in one alternative embodiment, a top layer material 72 in a liquid form, for example liquefied thermoplastic urethane, is poured or sprayed over the backing layer 42 from a source 74, thereby forming the top layer 40 upon solidification. Referring to FIG. 6B, in another alternative embodiment, the backing layer 42 is used as a part of a mold 76. The top layer 40 is then formed by injection molding in a cavity 78 of the mold 76.

Figure 7A:
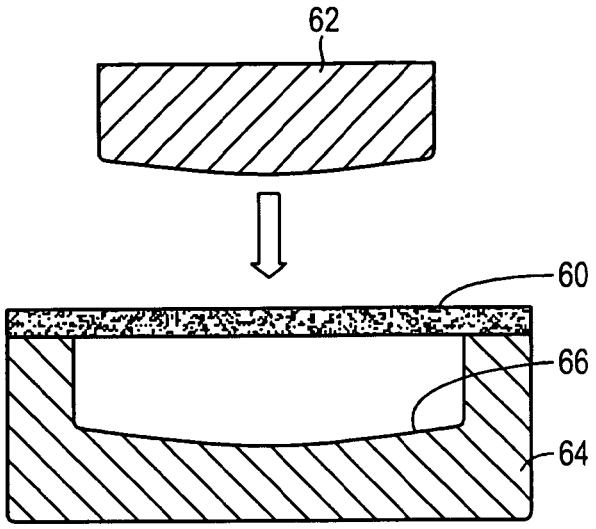
FIGS. 7A-7E depict a schematic representation of the steps of a method of manufacturing a multi-layer outer panel according to yet another alternative embodiment of the invention.
Figure 7B:
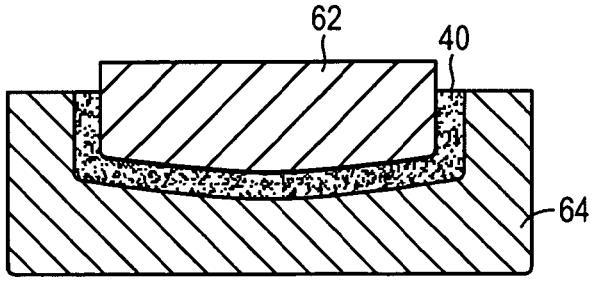

In yet another alternative embodiment, the panel 30 is manufactured by first producing the top layer 40 and then using the top layer 40 to produce the backing layer 42. Referring to FIGS. 7A-7B, a two-dimensional sheet 60 of the top layer material is heated, using, for example, infrared radiation or hot air, and then deep drawn by means of the moveable stamp 62 receivable in the mold 64 to form the top layer 40. The inner surface 66 of the mold 64 is convex and substantially corresponds to a section of the surface 45 of the bladder 22 or the carcass 27. Other methods of three-dimensional forming of the top layer 40, including, but not limited to, vacuum forming and injection molding, can also be used.

Figure 7C:
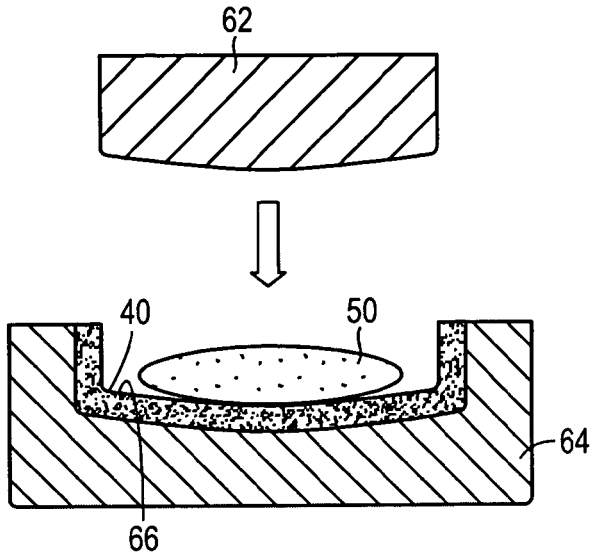
Figure 7D:
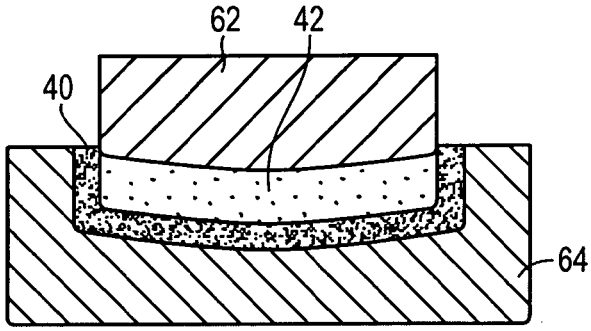
Figure 7E:
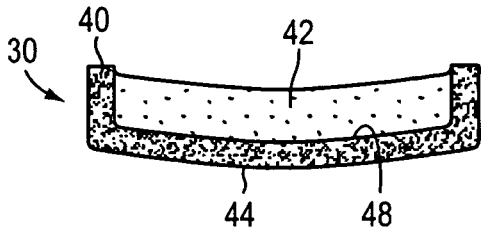

The backing layer 42 is produced as described above in connection with FIGS. 5A-5C with the top layer 40 disposed on top of the inner surface 66 of the mold 64 defining the shape of the outer surface of the backing layer 42, as shown in FIGS. 7C-7E.

Because the inner surface 48 of the top layer 40 is used to shape the outer surface 44 of the backing layer 42, the curvature of the outer surface 44 of the backing layer 42 substantially matches the curvature of the inner surface 48 of the top layer 40, and both of these surfaces substantially correspond to the section of the surface 45 of the bladder 22 or the carcass 27.

As discussed above in connection with FIG. 5F, the outer surface 44 of the backing layer 42 may be connected to the inner surface 48 of the top layer 40 either during the three-dimensional forming of the backing layer 42, or in a separate step after the backing layer 42 is formed. Suitable means to connect the backing layer 42 and the top layer 40 to form the outer panel 30 include, but are not limited to, chemical bonding and physical bonding, such as, for example, using an adhesive or welding, or a combination of chemical and physical bonding. In some embodiments, the resulting bond between the top layer 40 and the backing layer 42 is substantially free of mechanical stress at an interface therebetween, because of the matching contacting surfaces of the layers 40, 42. The impact strength and delamination resistance of the outer panel 30 is thereby improved.

In yet another alternative embodiment, the top layer 40 and the backing layer 42 may also be produced independently from each other. In this embodiment, the outer surface 44 of the backing layer 42 is dimensioned to match the inner surface 48 of the top layer 40 to provide a substantially stress-free connection of the top layer 40 and the at least one backing material 42 forming the outer panel.

Having described certain embodiments of the invention, it will be apparent to those of ordinary skill in the art that other embodiments incorporating the concepts disclosed herein may be used without departing from the spirit and scope of the invention. The described embodiments are to be considered in all respects as only illustrative and not restrictive.

What is claimed is:

1. A multi-layer outer panel for forming an outer layer of a game ball which is inflatable by air, a plurality of the multi-layer outer panels being interconnected for forming the outer layer, and the outer panel comprising:

(a) a top layer comprising a first material and having an outer surface and an inner surface, the outer surface of the top layer dimensioned to substantially correspond to a section of a surface of the game ball; and (b) at least one backing layer comprising a second material and having an outer surface and an inner surface, the inner surface of the at least one backing layer dimensioned to substantially correspond to the section of the surface of the game ball, the outer surface of the at least one backing layer configured to connect with the inner surface of the top layer, wherein the top layer and the at least one backing layer are preformed into an arcuate shape having a radius of curvature $R_P$, and the top layer and the at least one backing layer are adapted to have a radius of curvature corresponding to a radius of the game ball in an inflated state $P_A$, wherein the radius of curvature $R_P$ is smaller than the radius $P_A$.

2. The multi-layer outer panel of claim 1, wherein the radius of curvature $R_P$ substantially matches a radius of the game ball in an uninflated state $P_B$.

3. The multi-layer outer panel of claim 1, wherein the connection between the outer surface of the at least one backing layer and the inner surface of the top layer forms an interface between the top layer and the at least one backing layer such that the outer panel is substantially free of mechanical stress at the interface.

4. The multi-layer outer panel of claim 1, wherein the outer panel is configured to couple with other outer panels to form a self-supporting spherical structure.

5. The multi-layer outer panel of claim 1, wherein the first material comprises a thermoplastic elastomer.

6. The multi-layer outer panel of claim 5, wherein the thermoplastic elastomer is selected from the group consisting of polyurethane, polyester, polyamide, polyolefin, polyethylene, polyvinyl chloride, and polybutadiene.

7. The multi-layer outer panel of claim 1, wherein the top layer is substantially transparent.

8. The multi-layer outer panel of claim 7, wherein at least one of the inner surface and the outer surface of the first material comprises imprinted patterns, text, or graphics.

9. The multi-layer outer panel of claim 1, wherein the second material comprises a foam material.

10. The multi-layer outer panel of claim 9, wherein the foam material is selected from the group consisting of polyurethane, ethylene vinyl acetate, and latex.

11. The multi-layer outer panel of claim 1, wherein the second material comprises a mesh material.

12. The multi-layer outer panel of claim 1, wherein the outer surface of the at least one backing layer and the inner surface of the top layer are connected by at least one of a chemical bond, a physical bond, and an adhesive.

13. An outer layer for a game ball which is inflatable by air, a plurality of multi-layer outer panels being interconnected for forming the outer layer, and each outer panel comprising:

(a) a three-dimensional top layer comprising a first material and having an outer surface and an inner surface, the outer surface of the three-dimensional top layer dimensioned to substantially correspond to a section of a surface of the game ball; and (b) at least one three-dimensional backing layer comprising a second material and having an outer surface and an inner surface, the inner surface of the at least one three-dimensional backing layer dimensioned to substantially correspond to the section of the surface of the game ball, the outer surface of the at least one three-dimensional backing layer connected to the inner surface of the three-dimensional top layer, wherein the three-dimensional top layer and the at least one three-dimensional backing layer of each outer panel are preformed into an arcuate shape having a radius of curvature $R_P$, and the three-dimensional top layer and the at least one three-dimensional backing layer of each outer panel are adapted to have a radius of curvature corresponding to a radius of the game ball in an inflated state $P_A$, wherein the radius of curvature $R_P$ is smaller than the radius $P_A$.

14. The outer layer for a game ball of claim 13, wherein the connection between the outer surface of the at least one three-dimensional backing layer and the inner surface of the three-dimensional top layer forms an interface between the three-dimensional top layer and the at least one three-dimensional backing layer such that the outer panel is substantially free of mechanical stress at the interface.

15. The outer layer for a game ball of claim 13, wherein each of the plurality of multi-layer outer panels have edges that are interconnected to form the outer layer of the game ball.

16. The outer layer for a game ball of claim 15, wherein the outer layer comprises a self-supporting spherical structure.

17. The outer layer for a game ball of claim 15, wherein the outer layer surrounds a substantially air-impermeable bladder or a carcass.

18. The outer layer for a game ball of claim 13, wherein the first material comprises a thermoplastic elastomer.

19. The outer layer for a game ball of claim 13, wherein the three-dimensional top layer is substantially transparent.

20. The outer layer for a game ball of claim 13, wherein at least one of the inner surface and the outer surface of the first material comprises imprinted patterns, text, or graphics.

21. The outer layer for a game ball of claim 13, wherein the second material comprises a foam material or a mesh material.

22. The outer layer for a game ball of claim 13, wherein the outer surface of the at least one three-dimensional backing layer and the inner surface of the three-dimensional top layer are connected by at least one of a chemical bond, a physical bond, and an adhesive.

23. A game ball comprising:

(a) a substantially air-impermeable bladder having a substantially spherical shape;

(b) a plurality of panels, each panel comprising:

(i) a three-dimensional top layer comprising a first material and having an outer surface and an inner surface, the outer surface of the three-dimensional top layer dimensioned to substantially correspond to a section of a surface of the game ball; and (ii) at least one three-dimensional backing layer comprising a second material and having an outer surface and an inner surface, the inner surface of the at least one three-dimensional backing layer dimensioned to substantially correspond to the section of the surface of the game ball, the outer surface of the at least one three-dimensional backing layer connected to the inner surface of the three-dimensional top layer, wherein the three-dimensional top layer and the at least one three-dimensional backing layer of each panel are preformed into an arcuate shape having a radius of curvature $R_P$, and the plurality of panels are attached to form an outer layer of the game ball surrounding the substantially air-impermeable bladder, wherein a radius of the game ball in an inflated state $P_A$ exceeds the radius of curvature $R_P$, wherein the connection between the outer surface of the at least one three-dimensional backing layer and the inner surface of the three-dimensional top layer forms an interface between the three-dimensional top layer and the at least one three-dimensional backing layer such that the outer layer is substantially free of mechanical stress at the interface.

24. The game ball of claim 23, further comprising a reinforcing layer positioned between the plurality of panels and the substantially air-impermeable bladder.

25. The game ball of claim 24, wherein the reinforcing layer comprises a flexible, generally spherical skeletal frame separate from and surrounding the substantially air-impermeable bladder.

26. The game ball of claim 23, wherein the outer layer comprises a self-supporting spherical structure.

27. The game ball of claim 23, wherein the substantially air-impermeable bladder comprises an elastic material.

* * * * *